United States Patent [19]

Paulat

[11] Patent Number: 4,648,590

[45] Date of Patent: Mar. 10, 1987

[54] TRANSPORT DEVICE FOR PAPER SHEETS

[75] Inventor: Klaus Paulat, Schoneburg Schwendi, Fed. Rep. of Germany

[73] Assignee: Helmut Steinhilber, Rottweil, Fed. Rep. of Germany

[21] Appl. No.: 596,529

[22] Filed: Apr. 4, 1984

[30] Foreign Application Priority Data

Apr. 12, 1983 [DE] Fed. Rep. of Germany ..... 3313046

[51] Int. Cl.[4] ..... B65H 5/06

[52] U.S. Cl. ..... 271/272; 198/722; 276/171; 271/264

[58] Field of Search ..... 271/251, 274, 273, 272, 271/314, 264; 198/722; 226/171, 196

[56] References Cited

U.S. PATENT DOCUMENTS

| | | | |
|---|---|---|---|
| 1,292,128 | 11/1919 | Stevenson | 198/722 |
| 3,109,924 | 11/1963 | Frederick | 271/272 |
| 3,765,670 | 10/1973 | Johnson | 271/296 |
| 3,801,804 | 4/1974 | Von Glahn et al. | 271/272 |
| 4,015,839 | 4/1977 | McKee | 271/275 |
| 4,106,767 | 8/1978 | Schirrmeister et al. | 271/271 |
| 4,195,832 | 11/1980 | Krumrey | 271/272 |
| 4,373,712 | 2/1983 | Mitzel | 271/272 |

FOREIGN PATENT DOCUMENTS

| | | | |
|---|---|---|---|
| 0141333 | 9/1982 | Japan | 271/273 |

OTHER PUBLICATIONS

IBM Technical Disclosure Bulletin, "Paper Feed Aligner Mechanism" by G. D. Anderson, vol. 15, No. 4, Sep. 1972, p. 1253.

Xerox Disclosure Journal, "Sheet Delivery Device" by Nicholas Danchak and Leslie W. Maguire, vol. 4, No. 6, Nov./Dec. 1979, pp. 747 and 748.

*Primary Examiner*—George E. A. Halvosa
*Assistant Examiner*—M. C. Graham
*Attorney, Agent, or Firm*—Thomas P. Mahoney

[57] ABSTRACT

A transport device for paper sheets incorporates driven rollers which frictionally engage the paper sheets and are mounted on shafts arranged parallel with one another in the transport direction. Filaments extending in the transport direction are utilized to bias the paper sheets from below against the rollers. The filaments permit the paper sheets to glide or slide thereover and extend between the rollers in a lower tangential plane, said filaments being mounted elastically at one extremity thereof. A slight inclination of the shafts of the rollers causes the paper sheets to be transported while engaging a lateral guiding edge to accomplish transportation of said sheet in an accurately aligned manner.

4 Claims, 2 Drawing Figures

TRANSPORT DEVICE FOR PAPER SHEETS

BACKGROUND OF THE INVENTION

The invention relates to a transport device for paper sheets for causing the translation of said paper sheets from one point to another in various types of machines utilized in conjunction with the handling of paper sheets.

Various types of office machines necessitate the incorporation of means of internal transport of paper sheets. Typical machines are copying machines, sheet feeding devices for automatic typewriters, collating machines, sheet sorting machines, and the like. Conventional transporting devices include corresponding rollers which engage the upper and lower sides of the paper sheets to move them through the respective machine.

Consequently, rollers are located in two planes and the paper sheets are conveyed between the rollers. Generally, the rollers of one of the upper or lower sets of rollers is driven in order to transport the paper sheets and the other set of rollers serves as counter-pressure rollers to keep the paper sheets in frictional contact with the driven rollers.

Paper transport devices of the aforementioned conventional type are expensive to manufacture and occupy considerable space in the machine with which they are associated. In addition, the constant pressure exerted by the upper rollers on the lower rollers ultimately will cause wear on the roller surfaces entailing the ultimate replacement of worn rollers.

OBJECTS AND ADVANTAGES OF THE INVENTION

A primary object of my invention is the provision of a paper transporting device for machines of the aforementioned character which is considerably less expensive to produce than prior art constructions and requires much less space in the machine with which it is associated.

Another object of my invention is the provision of a transporting device for paper sheets which eliminates one set or bank of rollers, retaining only the driven bank of rollers and utilizing lineal pressure means associated with the driven bank of rollers to retain the paper sheets in frictional engagement with the surfaces of the driven bank of rollers.

The elimination of the bank or set of rollers customarily utilized to force the paper sheets into frictional engagement with the roller surfaces of the driven bank of rollers considerably reduces the size of the paper transporting device of my invention and, consequently, materially reduces the space occupied by the paper transporting device of my invention in conventional machines with which it is associated.

A further object of my invention is the provision of a transporting device for paper sheets wherein the bank of pressure rollers is eliminated and the sheets are retained in operative relationship with the driven bank of rollers by means of continuous filaments extending in the direction of paper transport and arranged underneath the bank of driven rollers.

Another object of my invention is the provision of a paper transport device of the aforementioned character in which the filaments incorporate smooth surfaces facilitating the expeditious movement of the paper sheets thereover with minimal resistance as induced by the driven rollers of the bank of driven rollers.

A further object of my invention is the provision of a paper transport device of the aforementioned character wherein the filaments are arranged to engage the lower tangential plane of the driven rollers which coincides with the plane of movement of the transported paper sheets.

Another object of my invention is the provision of a device of the aforementioned character in which the aforesaid filaments are so disposed that they are urged into positions which are slightly higher than the tangential plane of the lower portions of the driven rollers. In any event, the filaments are so disposed that, due to the inherently elastic character thereof, they frictionally urge the paper sheets against the lower tangential plane of the driven rollers.

An associated object of the invention is the provision of filaments manufactured from synthetic polymers such as the polyamides, a commercial example of which are the well-known "Nylon" filaments manufactured by DuPont. These filaments are characterized by a surface having excellent smoothness characteristics which reduce the frictional resistance of the paper sheets to movement thereover. At the same time, the filaments are of high-tensile and breaking strengths and exhibit considerable resistance to wear and abrasion.

A further object of my invention is the provision of a device of the aforementioned character in which the filaments are elastically mounted, as, for example, by means of spirally wound tension springs. The spring rate of the springs is such that the filaments engage the paper sheets being transported through the device under relatively light pressure as they urge the sheets against the rollers. Consequently, the pressure exerted by the filaments does not impede the smooth transport of the paper sheets along the upper surfaces of the filaments.

It is preferable that several rollers are mounted on driven shafts which are axially spaced along the paper transport path. This arrangement permits the filaments to be located in the axial openings or gaps between the rollers so that they can extend into the lower tangential plane of the rollers or, if desired, slightly above the tangential plane.

By so arranging the filaments with respect to the rollers and because of the resilience imparted to the filaments by the associated tension springs, the pressure exerted by the filaments on the undersides of the paper sheets to press said sheets against the driven rollers can be established in a very accurate manner.

Consequently, the resulting pressure of the paper sheet against the rollers is sufficient to transport the paper sheet by frictional engagement of the sheet with the rollers and, conversely, the friction between the paper sheets and the driven rollers and filaments is established in a very low order of magnitude. As a result of the reduction of friction between the various components of the paper transport device and the components of said device, the driving force necessary to actuate said device is considerably less than conventional paper transport devices wherein considerable frictional loss is encountered because of the impingement of the driven and backup rollers on one another. The use of filaments in place of the bank of pressure rollers considerably reduces the production costs of the transporting device. Furthermore, owing to the elimination of the bank of pressure rollers, the dimension of the transporting track in perpendicular direction to the paper sheets is cut in half.

Since the paper sheets are retained elastically against the driven rollers by means of the filaments, the contact pressure of the paper sheets, which is only of a very small order of magnitude, is independent of the thickness of the paper sheets. In the case of a thicker paper sheet or in the case of a set of paper sheets, the filaments are merely urged slightly from the tangential plane of the driven rollers, without materially changing the elastic restoring force of the filaments with the contact pressure against the driven rollers.

This is an essential advantage over conventional transport devices, in which the space between the driven rollers and the pressure rollers has to be very accurately adjusted to the utilized paper thickness. If the space or distance is too small, it leads to jamming of the paper, whereas a distance which is too great leads to unreliable transport of the paper sheets.

In a preferred form of the invention, a lateral edge of the transport device operates as a guiding edge on which the paper sheets impinge during the transport thereof. The shafts for the rollers are slightly inclined so that, in the transport direction, they form an angle with the guiding edge which is somewhat smaller than 90°. The inclination of the axes of the rollers results in the paper sheets being continuously urged against the guiding edge. The paper sheets are, therefore, reliably transported along the guiding edge, while the filaments prevent buckling or jamming of the sheets along the guiding edge.

In the transport device, or at the end of the same, a stop for positioning of the paper sheets can be provided, against which the paper sheets are pushed by the rollers. When the leading edge of a paper sheet comes to lie against such a stop, then, based on the elastic resilience and the smoothness of the filaments, the sheet of paper stops at that position, even though driven by the rollers, avoiding jamming of the sheet of paper at the stopping element.

In the case of the conventional transport devices, this is possible only when the distance between the driven rollers and the pressure rollers is extremely accurately adjusted to the thickness and stiffness of the paper. Slight changes in the stiffness or thickness of the paper, as brought about by changes in humidity, can lead to jamming in the case of conventional transport devices.

Other objects and advantages of the invention will be apparent from the following specification and the accompanying drawings illustrating a preferred embodiment of the invention.

DESCRIPTION OF THE PREFERRED EMBODIMENT OF THE INVENTION

Figure 1:
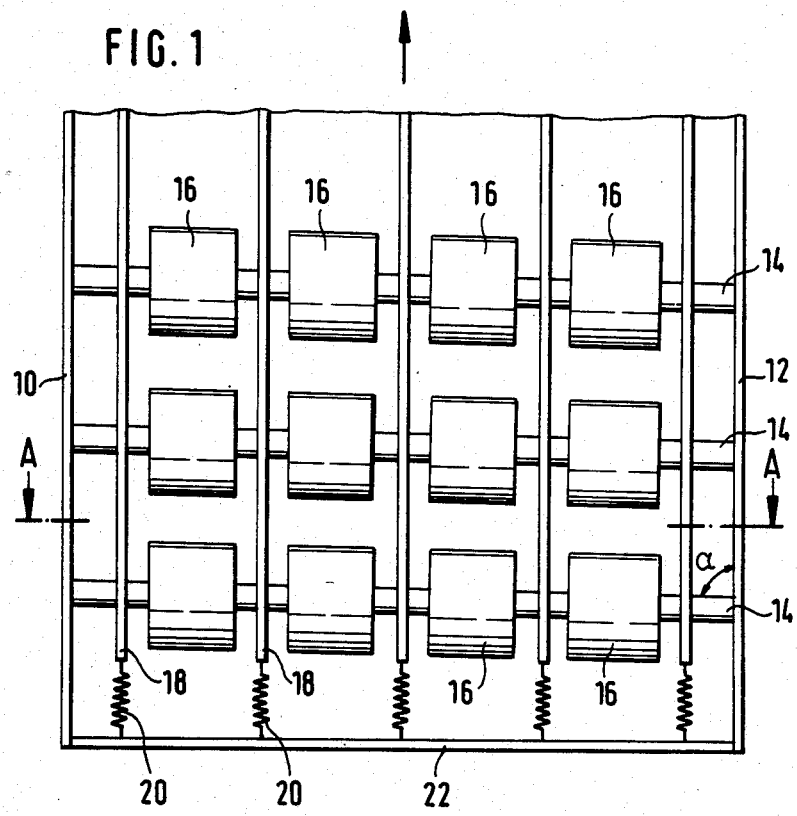
FIG. 1 is a bottom view of a transport device.

Referring to the drawings and, particularly, to FIG. 1 thereof, it should be noted that only the inlet side of the transport device is shown, that is, the rear section of the transport device viewed in the transport direction as indicated by the arrow in FIG. 1.

The length of the transport device is determined by the nature of the machine in which the transport device is installed. Only the transport device itself and a portion of the mounting frame thereof is illustrated in the drawings since the particular machine in which the transport device is incorporated is not material in considering the subject matter of the invention.

The transport device includes side walls 10 and 12 which extend in the transport direction and are interconnected with one another to form a framework by means of transverse frame members, one of which is shown at 22. Shafts 14 are pivotally mounted in the side walls 10 and 12. The shafts 14 are arranged in transverse direction to the transport direction and at equal distance from one another and lie in a common plane.

The shafts 14 can be driven by means of an electric motor or by means of a gear unit, not illustrated, which engages with shafts 14. At mutual axial distance, rollers 16 are fixedly mounted on shafts 14. The peripheries of the rollers 16 are capable of providing friction by means of rubber surfaces.

Located beneath the shafts 14 are filaments 18 which extend in the transport direction. It will be noted that the filaments are located in the gaps between the rollers and, in the case of the outermost rollers, they are located in the spaces between the outer edges of the rollers and the adjacent side walls 10 and 12. Although the disclosure of the preferred embodiment of the invention exemplifies the transport device as incorporating elongated filaments having smooth surfaces to facilitate the sliding of the paper sheets thereover, it will be obvious to those skilled in the art that various elongated elements, such as plastic tubings of reduced diameters or glass filaments, may be utilized in substitution for the particular type of filaments disclosed hereinbelow.

As previously mentioned, the filaments utilized in the present embodiment of the invention are manufactured from polyamide polymers, although it will be obvious to those skilled in the art that filaments manufactured from other types of polymers may be utilized in substitution therefor.

The ends of the filaments 18 are supported upon the transverse frame member 22 by means of spiral tension springs 20. The extremities of the filaments 18 located at the discharge end of the transport device may be wound upon a cylindrical transverse support member, not shown, to provide for easy sheet discharge. The ends of the filaments 18 at the exit end of the transport device are fixedly secured to the support member.

Figure 2:
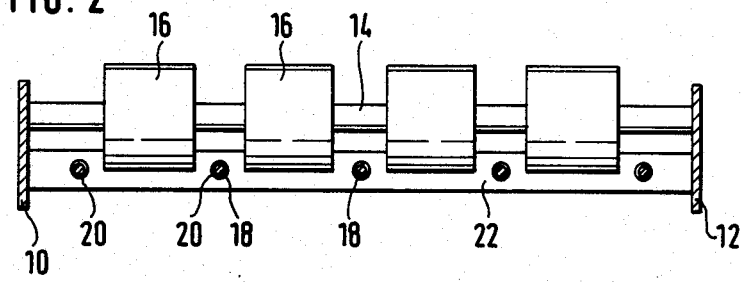
FIG. 2 is a vertical section through the transport device on line A—A of FIG. 1.

It will be noted that, as best shown in FIG. 2 of the drawings, the location of the filaments 18 in the spaces between the rollers and the side walls 10 and 12 disposes the upper surfaces thereof a slight distance above the tangential plane of impingement of a sheet of paper on the surfaces of the driven rollers 16.

The axes of the shafts 14 are not arranged at an exact 90° angle with respect to the transport direction and the side walls 10 and 12, but are arranged angularly with respect thereto to enclose an angle alpha which opens in the transport direction and, in conjunction with the side wall 12, is slightly smaller than 90°, as best shown in FIG. 1 of the drawings. The variance of the angle alpha from 90° is of a very low order of magnitude and amounts to only a few degrees, but is illustrated in FIG. 1 of the drawings in an exaggerated manner for illustrational purposes. The inner surface of the side wall 12 acts as a guiding edge to facilitate the translation of the edges of the sheets of paper thereover.

Paper sheets are introduced into the transport device track from the top, either as individual sheets or assembled collations of paper sheets. The paper sheets can be introduced at the inlet end of the transport device or can be introduced in transport direction at any desired place between the shafts 14 and are then transported between the filaments 18 and the rollers 16. Due to the elastic mounting means of the spiral tension springs 20, the filaments 18 are urged downwardly to such an extent that the paper sheets lie tangentially against the rollers 16. Thus, the elastic mounting of the filaments 18 causes the paper sheets, independently of their thickness, to be frictionally retained against the rollers 16 with a very low contact pressure. The driven rollers 16 frictionally engage the paper sheets sliding along the filaments 18 and urge the paper sheets in transport direction.

Due to the slight inclination of the shafts 14, a small component of the feeding force exerted on the paper sheets by the rollers 16 is exerted toward the right side in a direction perpendicular to the feed direction. Through this small force component, the paper sheets are pushed toward the right side and are retained during the transport movement along the guiding edge formed by the side wall 12. At the end of the transport device, when the paper sheets are discharged to a subsequent processing station, the paper sheets are accurately aligned and positioned at their right side edges. When, at the transport device's discharge end, not shown, the filaments 18 are downwardly guided through the intervention of a round transverse rod, the paper sheets can emerge and be discharged in an umimpeded manner.

Through the surface smoothness of the filaments 18 and the guiding edge along the inner side of the side wall 12 jamming of the paper sheets between rollers 16 and side wall 12 is prevented, despite the fact that the component of the feed force is directed perpendicularly with respect to the guiding edge.

Because of the spiral tension springs 20 and the arrangement of the filaments 18 with respect to the lower tangential plane of the rollers 16, the contact pressure of the paper sheets exerted against the driving rollers 16 can be selected in such a manner that, when the paper sheets come to a standstill, jamming of the paper sheets does not take place, even when the leading edges of the paper sheets engage a stop which projects into the transport device, for example, for the control of the discharge of paper sheets through the office machine.

The resilience of the elastically suspended filaments 18 is sufficient to permit the overrunning of rollers 16 on the paper sheets during the immobility of a paper sheet lying against such a stop. Since the elastic force of the filaments, due to their length and the suspension by means of the spiral tension springs 20, is practically independent of their deflection from their initial position, the reliable transporting of the paper sheets and the overrunning of the rollers 16 are very compatible with the thickness and stiffness of the paper sheets when the latter are immobile. Consequently, the operation of the transport device is reliable and troublefree.

I claim:

1. In a transport device for feeding paper sheets along a predetermined path, the combination of: supporting means; a plurality of axially stationary, rotatably driven shafts mounted in parallelism on said supporting means; a plurality of driven rollers affixed to each of said shafts in spaced relationship for frictionally engaging and transporting said paper sheets along said path, said path being along a plane tangential to the surfaces of said rollers and the spaces between said rollers on said plurality of shafts being aligned; and a plurality of elongated, flexible filaments mounted, under tension, on said supporting means and extending parallel to the transport direction of said sheets and having smooth surfaces, said filaments being aligned with the spaces between said rollers and located within said predetermined path for resiliently urging said paper sheets against said rollers.

2. The transport device of claim 1 in which said filaments have portions thereof disposed between the axes and tangential plane of said rollers.

3. The transport device of claim 1 in which said filaments are of tubular cross section.

4. The transport device of claim 3 in which the tubular cross section of said filaments intersects the tangential plane of said rollers.

* * * * *